US010087622B2

(12) United States Patent
Miller

(10) Patent No.: US 10,087,622 B2
(45) Date of Patent: Oct. 2, 2018

(54) SELF-ALIGNING CORNER BEAD FOR FIREPROOFING STRUCTURAL STEEL MEMBER AND METHOD OF USING SAME

(71) Applicant: Philip Glen Miller, Lake Charles, LA (US)

(72) Inventor: Philip Glen Miller, Lake Charles, LA (US)

( * ) Notice: Subject to any disclaimer, the term of this patent is extended or adjusted under 35 U.S.C. 154(b) by 0 days.

(21) Appl. No.: 15/382,687

(22) Filed: Dec. 18, 2016

(65) Prior Publication Data

US 2017/0096811 A1 Apr. 6, 2017

Related U.S. Application Data

(63) Continuation of application No. 14/832,074, filed on Aug. 21, 2015, now Pat. No. 9,540,813, which is a (Continued)

(51) Int. Cl.
*E04B 1/94* (2006.01)
*E04C 3/293* (2006.01)
(Continued)

(52) U.S. Cl.
CPC ..... *E04B 1/944* (2013.01); *E04C 3/06* (2013.01); *E04C 3/293* (2013.01);
(Continued)

(58) Field of Classification Search
CPC .... E04B 1/944; E04C 3/06; E04C 2003/0452; E04C 3/293; E04F 13/06; E04F 13/068;
(Continued)

(56) References Cited

U.S. PATENT DOCUMENTS 131,506 A * 9/1872 Corbett ..... E04F 13/06 52/255
RE5,179 E * 12/1872 Corbett ..... E04F 13/06 52/255

(Continued)

FOREIGN PATENT DOCUMENTS

WO 2012105858 8/2012

OTHER PUBLICATIONS

Stockton Wire Products, "Plastic Nose Weep-Aid® for better construction", Pages from brochure, printed 1989, 3 pages.

*Primary Examiner* — Brent W Herring
(74) *Attorney, Agent, or Firm* — Katarzyna Brozynski; Antonio Devora

(57) ABSTRACT

A self-aligning corner bead for fireproofing structural steel, having a strip of welded wire fabric cut to the appropriate width for the fireproofing thickness and bent longitudinally to form an obtuse V-shaped device is disclosed. A plastic nosing is installed along one edge. A method of finishing the corners for fireproofing of structural steel member using an improved corner bead includes the step of attaching the first wing of an obtuse V-shaped device through a lathe to the structural steel member utilizing pneumatic or screw type fasteners. The mesh structure of the second wing of the V-shaped device provides a dam to form a roughened surface on the first application of fireproofing material until it hardens.

7 Claims, 8 Drawing Sheets

Related U.S. Application Data continuation-in-part of application No. 14/292,881, filed on May 31, 2014, now Pat. No. 9,140,005.

(60) Provisional application No. 62/040,182, filed on Aug. 21, 2014, provisional application No. 61/830,257, filed on Jun. 3, 2013.

(51) Int. Cl.

| | |
|---|---|
| ***E04C 3/06*** | (2006.01) |
| *E04F 13/06* | (2006.01) |
| *E04F 13/04* | (2006.01) |
| *E04C 3/04* | (2006.01) |

(52) U.S. Cl.

CPC ..... *E04C 2003/0452* (2013.01); *E04F 13/047* (2013.01); *E04F 13/068* (2013.01); *Y10T 428/1241* (2015.01)

(58) Field of Classification Search

CPC ..... E04F 2013/063; E04F 13/047; Y10T 428/1241

USPC ..... 52/255

See application file for complete search history.

(56) References Cited

U.S. PATENT DOCUMENTS 583,413 A * 5/1897 Meserve ..... E04F 13/06 52/255
624,076 A * 5/1899 Parker ..... E04F 13/06 52/255
632,007 A * 8/1899 Broome ..... E04F 13/06 52/255
640,409 A 1/1900 Parker
658,386 A 9/1900 Mitchell
1,110,369 A 9/1914 Bagnall et al.
1,122,076 A * 12/1914 Collins ..... E04F 13/06 52/255
1,210,560 A 1/1917 Tappen
1,419,232 A 6/1922 Curtis
1,608,475 A 11/1926 Dean
1,624,121 A * 4/1927 Thiem ..... E04F 13/06 52/255
1,782,147 A 11/1930 Merryweather
1,858,836 A 5/1932 Martell
1,907,990 A * 5/1933 Manske ..... E04F 13/06 29/6.2
1,988,081 A 1/1935 Kemper
2,005,572 A 6/1935 Vass
2,012,203 A 8/1935 Peterson
2,061,050 A * 11/1936 Stafford ..... E04F 13/06 52/255
2,074,463 A * 3/1937 Davis ..... E04B 1/944 52/105
2,127,806 A 8/1938 Burt
2,196,086 A * 4/1940 Sprouse ..... E04F 13/06 52/255
2,213,603 A 9/1940 Young et al.
2,267,002 A * 12/1941 Turner ..... E04F 13/06 52/255
2,370,052 A 2/1945 Lindelow
2,391,581 A * 12/1945 Markuson ..... E04F 13/06 52/253
2,465,756 A 3/1949 Schepis
2,483,888 A * 10/1949 Danielson ..... E04F 13/06 4/538
2,702,932 A 3/1955 Woodson
2,945,329 A 7/1960 Schneller
2,969,616 A * 1/1961 Gustafson ..... E04F 13/06 52/255
3,175,330 A 3/1965 Holson
3,217,456 A 11/1965 Quigg
3,255,561 A * 6/1966 Cable ..... E04F 13/06 52/255
3,295,268 A * 1/1967 Gaither ..... E04F 13/06 52/255
3,345,788 A 10/1967 Holsman
3,412,512 A 11/1968 Hollister
3,516,213 A 6/1970 Sauer
3,748,815 A 7/1973 Parker
3,772,844 A 11/1973 Thome
3,908,327 A 9/1975 Quigg
3,913,290 A 10/1975 Billing et al.
4,043,092 A 8/1977 Paul et al.
4,069,075 A 1/1978 Billing et al.
4,391,074 A 7/1983 Holsman
4,493,945 A * 1/1985 Feldman ..... A62C 3/16 174/68.3
4,683,019 A 7/1987 Motoki
4,729,916 A * 3/1988 Feldman ..... A62C 3/16 156/292
4,854,107 A 8/1989 Roberts
4,955,173 A 9/1990 Czechowski
5,073,430 A * 12/1991 Aidan ..... E04F 19/061 428/192
5,157,887 A 10/1992 Watterworth, III et al.
5,398,472 A 3/1995 Eichelkraut
5,433,991 A 7/1995 Boyd
5,580,648 A 12/1996 Castle et al.
5,625,986 A 5/1997 Mansfield et al.
5,685,116 A 11/1997 Bradshaw et al.
5,788,403 A 8/1998 Dison et al.
6,591,566 B1 7/2003 Rodlin
6,698,144 B1 * 3/2004 Larson ..... E04B 1/765 52/202
7,921,537 B2 4/2011 Rodlin
8,291,676 B2 10/2012 Hong et al.
8,555,593 B2 10/2013 Ramos
9,140,005 B2 * 9/2015 Miller ..... E04B 1/944
9,540,813 B2 * 1/2017 Miller ..... E04C 3/293
2002/0005023 A1 * 1/2002 Ford ..... E04B 1/26 52/514
2003/0024188 A1 * 2/2003 Smythe, Jr. ..... B32B 29/00 52/255
2003/0079429 A1 5/2003 Rodlin
2004/0250488 A1 12/2004 Rodlin
2007/0119106 A1 5/2007 Sacks et al.
2008/0282644 A1 11/2008 Hong et al.
2012/0085047 A1 4/2012 Hiscock et al.
2012/0110936 A1 * 5/2012 Egan ..... E04F 13/06 52/255
2013/0205696 A1 * 8/2013 Little ..... E04F 13/06 52/255

* cited by examiner

SELF-ALIGNING CORNER BEAD FOR FIREPROOFING STRUCTURAL STEEL MEMBER AND METHOD OF USING SAME

CROSS-REFERENCE TO RELATED APPLICATIONS

This application is a continuation of U.S. application Ser. No. 14/832,074, filed Aug. 21, 2015, which claims priority to U.S. Provisional Application No. 62/040,182, filed Aug. 21, 2014. U.S. application Ser. No. 14/832,074 is also a continuation-in-part of U.S. application Ser. No. 14/292,881, filed May 31, 2014, now U.S. Pat. No. 9,140,005, issued Sep. 22, 2015, which claims priority to U.S. Provisional Application No. 61/830,257, filed Jun. 3, 2013. Each of the above patent applications is incorporated by reference herein in its entirety to provide continuity of disclosure.

TECHNICAL FIELD

The present invention relates generally to a corner bead for cementitious fireproofing of structural steel members and, more particularly, to a device that is self-aligning in installation and allows the accurate gauging of the thickness of the fireproofing material along three surfaces.

BACKGROUND OF THE INVENTION

In the art of a corner bead for fireproofing structural steel, prior approaches conventionally include a v-bend corner bead having adjustable legs (flanges). This type of corner bead is mostly used in the plastering and stucco trades. The previously utilized corner bead is constructed of wires welded into a lattice that is v-shaped in section as shown in FIG. 1.

In installation, the longitudinal base wires of the v-shaped corner bead are attached with a tie wire either onto a metal lath or onto a wire mesh, and further attached to the steel member to be fireproofed as shown in FIG. 2. At best, this allows for distribution of the fireproofing material along two surfaces after a complex negotiation of the correct height of the two flanges; to wit, to establish the correct fireproofing thickness, one must establish the correct height of the vertex by shrinking or expanding the distance between the legs (flanges) of the corner bead defined by the vertex. Using this technique, the alignment of the corner bead with the adjacent surface is difficult and great skill is required to install the corner bead for fireproofing structural steel.

The prior art includes many problems, including the difficulty of properly adjusting the traditional corner bead to the adjacent surface, the uneven application of fireproofing material, and the lack of a dam for the wet cement material. Despite these well-known and long-existing problems, and a readily apparent market for a solution, the prior art does not disclose or suggest a viable, cost-effective solution to the aforementioned problems of the prior art.

Accordingly, a need exists for an improved corner bead to avoid inaccuracy in gauging the thickness of the fireproofing material and to allow easy installation along three surfaces. An improved self-aligning double wire corner bead is inexpensive to manufacture and easy to install.

SUMMARY

The present invention provides a self-aligning, double wire corner bead that allows to make, in an accurate and quick manner, corners of a fireproofing material around structural steel members, said fireproofing material having uniform thickness around the structural steel member. This is accomplished by bending a single strip of welded wire fabric of pre-determined width along a plurality of longitudinally extending lines (axes) to provide a profile of a metal sheet having a plurality of dihedral angles, two wings of the desired width, a single wire membrane and a double wire membrane, said double wire membrane comprising a first leg and a second leg as substantially shown in FIGS. 4 and 5.

The angle at which each wing meets the single wire membrane and a second leg of the double wire membrane of the device, respectively, determines the thickness of the fireproofing material distributed around the structural steel member along three surfaces. Further, said thickness may be modified by changing the width of each respective wing. The uniformity in thickness of the fireproofing material distributed around three surfaces of the structural steel member is achieved by bending the first wing and the second wing at approximately the same angle in relation to the single wire membrane and the second leg of the double wire membrane, respectively. The uniformity in thickness of the fireproofing material distributed around all surfaces of the structural steel member in a contour type application is achieved by using the same width of the single metal strip bent to create an identical single metal sheet profile for all corners of the structural steel member.

It is further an object of the present invention to provide an improved corner bead for fireproofing structural steel without the need of adjusting the legs.

Another object of the present invention is to provide novel means of installing the corner bead by easier attachment to the structural steel.

Another object of the present invention is to provide an improved technique for application of accurate thickness of fireproofing material along three surfaces under any construction condition for making said fireproofing of structural steel members.

A further object of the present invention is to provide a dam to form a roughened surface on the first application of fireproofing material until it hardens along three surfaces.

While satisfying these and other related objectives, the present invention provides an improved, self-aligning, double wire corner bead for fireproofing structural steel which is very competitive from a mere economic standpoint. The corner bead of the present invention consists of a single strip of welded wire fabric cut to a desired width for the fireproofing thickness and bent along a plurality of longitudinal axes to form a set of wings, a single wire membrane, and a double wire membrane, said double wire membrane having a first leg and a second leg, said first leg seamlessly becoming said second leg through a process of bending of said double wire membrane such that said first leg is substantially parallel to said second leg, and wherein said single wire membrane and said double wire membrane are attached by the attachment means to the lath distributed around the structural steel member.

In accordance with the present invention, the corner bead includes a single elongated strip of welded wire fabric of pre-determined width, said single strip of welded wire fabric comprising a set of flexible mesh strips as shown in FIG. 3.

According to one embodiment of the present invention, the improved double wire corner bead allows each element of the bent wire mesh of the corner bead to perform different functions that are essential for the successful completion of the fireproofing process along three surfaces.

The single wire membrane and the double wire membrane provide a flat portion of a grid (mesh) through which pneumatic or screw type fasteners attach the mesh to the structural steel at the appropriate location. In addition, the double-wire membrane provides additional support for two wings positioned at the opposite corners of the steel structure member, hence facilitating one piece of wire mesh to cover two corners and three surfaces of the structure. This easy application establishes automatic alignment of the corner bead along three surfaces, eliminates the cumbersome process of shrinking or expanding the distance between the legs of the traditional bead, as well as provides only one strip of metal of the desired width to allow fireproofing of two corners of the steel structure member along three surfaces at the same time in a contour-method application of the fireproofing material.

The width of the set of wings and/or the angle at which the first and the second wing meet the single wire membrane and the second leg of the double wire membrane, respectively, determines the thickness of the fireproofing material distributed along three surfaces by providing a rigid screed edge along a nose. Therefore, the correct amount of fireproofing material is distributed adjacent to the corner bead creating a leveled application throughout the surface.

The width of the set of wings also provides a dam to form a roughened surface on the first application of the fireproofing material until the fireproofing material hardens. This forming action allows successive application of the cement material to the adjacent surface.

In another aspect, the present invention includes a method of manufacturing an improved self-aligning, double wire corner bead for fireproofing structural steel comprising a single strip of welded wire fabric cut to the desired width for the fireproofing thickness and bent along a plurality of longitudinally extending lines (axes) to form a profile of a metal sheet, a first longitudinal line to define a first wing and a single wire membrane extending laterally therefrom at a first angle of approximately greater than 90 degrees but less than approximately 180 degrees relative to each other and wherein said single wire membrane is secured to a structural steel member and said first wing is configured to establish a desired thickness of the fireproofing material along two surfaces by providing a rigid screed edge along the nose, a second longitudinal line to define said single wire membrane and a first leg of a double wire membrane extending from said single wire membrane in a continuous manner and at a second angle of approximately 90 degrees relative to each other, a third longitudinal line to define said first leg of said double wire membrane and a second leg of said double wire membrane such that said first leg is positioned substantially parallel to said second leg (the second leg substantially overlaps the first leg), and wherein said double wire membrane is secured to said structural steel member, and a fourth longitudinal line to define a second wing and said second leg of said double wire membrane, said second leg extending downwardly from said second wing at a third angle of approximately greater than 90 degrees but less than approximately 180 degrees relative to each other, and wherein said third angle is substantially equal to said first angle.

In a further aspect, the present invention includes a method of finishing a set of corners for cementitious fireproofing in a contour application of a set of structural steel members, the method comprising the steps of: selecting a corner bead comprising a single strip of welded wire fabric cut to the appropriate width for the fireproofing thickness and bent along a plurality of longitudinally extending lines, to provide a profile having a plurality of dihedral angles, wherein a first longitudinal line to define a first wing and a single wire membrane extending laterally therefrom at a first angle of approximately greater than 90 degrees but less than approximately 180 degrees relative to each other and wherein, said single wire membrane is secured to a structural steel member and a first wing is configured to establish a desired thickness of the fireproofing material along two surfaces by providing a rigid screed edge along the nose, a second longitudinal line to define said single wire membrane and a first leg of a double wire membrane extending from said single wire membrane in a continuous manner and at a second angle of approximately 90 degrees relative to each other, a third longitudinal line to define said first leg of said double wire membrane and a second leg of said double wire membrane such that said second leg is extending from said first leg of said double wire membrane in a continuous manner in such a way that said first leg is positioned substantially parallel to the second leg (the second leg substantially overlaps the first leg), and wherein said double wire membrane is secured to said structural steel member, and a fourth longitudinal line to define a second wing and said second leg of said double wire membrane, said second leg extending downwardly from said second wing at a third angle of approximately greater than 90 degrees but less than approximately 180 degrees relative to each other, and wherein said third angle is substantially equal to said first angle.

A dihedral angle (also called a face angle) is the internal angle at which two adjacent faces of each section member of the double wire corner bead is delimited by the two inner faces, e.g., angle $\alpha_1$ formed between adjacent faces of the first wing and the single wire membrane, angle $\alpha_2$ formed between adjacent faces of the second wing and the second leg of the double wire membrane and angle $\beta$ formed between adjacent faces of the single wire membrane and the first leg of the double wire membrane. The fourth angle created along the third longitudinal line between the first and the second leg of the double wire membrane is substantially zero (0) degrees so that the first leg and the second leg substantially overlap each other, and are approximately parallel, with respect to each other.

In another embodiment, the aim of the present invention is to provide a self-aligning corner bead which allows to make, in an accurate and quick manner, corners of the fireproofing material around structural steel members, said fireproofing material having uniform thickness around the structural steel. This aim is achieved owing to the fact that a strip of welded wire fabric having pre-determined width is bent along its longitudinal axis forming two wings of the desired width. The width of the second wing as well as the angle at which the two wings meet along the longitudinal axis determine the thickness of the fireproofing material strip disposed around the structural steel member along two surfaces. The uniformity in thickness of the fireproofing material distributed around the structural steel member is achieved by using the same width of the second wing bent at the same angle in relation to the first wing for all utilized corner beads, whether in a contour or a hollow-box type application.

It is further an object of the present invention to provide an improved corner bead for fireproofing structural steel without the need of adjusting the legs.

Another object of the present invention is to provide novel means of installation of the corner bead by easier attachment to the structural steel.

Another object of the present invention is to provide an improved technique for application of accurate thickness of fireproofing material along two surfaces under any construction condition for making said fireproofing of structural steel members.

A further object of the present invention is to provide a dam to form a roughened surface on the first application of fireproofing material until it hardens.

In satisfaction of these and related objectives, applicant's present invention provides an improved corner bead for fireproofing structural steel which is very competitive from a mere economic standpoint. The corner bead of the present invention consists of a strip of welded wire fabric cut to the appropriate width for the fireproofing thickness and bent longitudinally to form an obtuse V-shaped device.

In accordance with the present invention, the corner bead includes an elongated strip of welded wire fabric of predetermined width, said strip bent along its longitudinal axis to define a pair of laterally extending wings, said wings comprising a flexible mesh strip.

According to one embodiment of the present invention, the improved corner bead allows each wing of the corner bead to perform different functions that are essential for the successful completion of the fireproofing process along two surfaces.

The width of the first wing provides a flat portion of metal grid (mesh) through which pneumatic or screw type fasteners attach the mesh to the lath disposed over the structural steel at the appropriate location. This easy application establishes automatic alignment and eliminates the cumbersome process of shrinking or expanding the distance between the legs of the traditional bead.

The width of the second wing and/or the angle at which the first and the second wing meet determines the thickness of the fireproofing material along two surfaces. The location of the rigid screed edge along the plastic nosing allows the correct amount of material to be distributed alongside the corner bead creating a leveled application throughout the surface.

The width of the second wing also provides a dam to form a roughened surface on the first application of the fireproofing material until it hardens. This forming action allows successive application of the cement material to the adjacent surface.

In another aspect, the present invention resides in a method of manufacturing an improved corner bead for fireproofing structural steel comprising a strip of welded wire fabric cut to the appropriate width for the fireproofing thickness and bent along the longitudinal axis to form an obtuse V-shaped device, said longitudinal axis to define a pair of wings extending laterally therefrom at an angle of approximately more than 90 degrees but less than approximately 180 degrees relative to each other and, wherein said first wing is secured to a structural steel member through a lath, said lath disposed around the structural steel member to hold the fireproofing material to said structural steel member, and a second wing configured to establish a desired thickness of the fireproofing material along two surfaces by providing a rigid screed edge along the plastic nosing.

In a further aspect, the present invention resides in a method of finishing the corners for cementitious fireproofing (whether in a hollow box or a contour application) of structural steel members, the method comprising: selecting a corner bead comprising a strip of welded wire fabric cut to the appropriate width for the fireproofing thickness and bent along its longitudinal axis to form an obtuse V-shaped device, said longitudinal axis to define a pair of wings extending laterally therefrom at an angle of approximately more than 90 degrees but less than approximately 180 degrees relative to each other; said first wing attached by joining means (attachment means) for securing said corner bead's first wing to a lath or mesh previously attached to a structural steel member and a second wing configured to establish a desired thickness of the fireproofing material along two surfaces by providing a rigid screed edge along the plastic nosing; attaching said first wing through said lath to the structural steel member; and applying successive layers of the fireproofing material to allow creation of the roughened cementitious surface, and tapering to the outward extending width of the second wing.

Applicant's approach to the problem described above is certainly simple, but it is equally unobvious. With over twenty years of experience in the field of fireproofing services, applicant is well educated on the challenges involved such as the difficulty of properly adjusting the traditional corner bead to the adjacent surface, the uneven application of fireproofing material, and the lack of dam for the wet cement material. Despite these well-known and long-existing problems, and a readily apparent market for a solution, no one has presented a viable, cost-effective solution such as applicant here provides.

DETAILED DESCRIPTION

Figure 1:
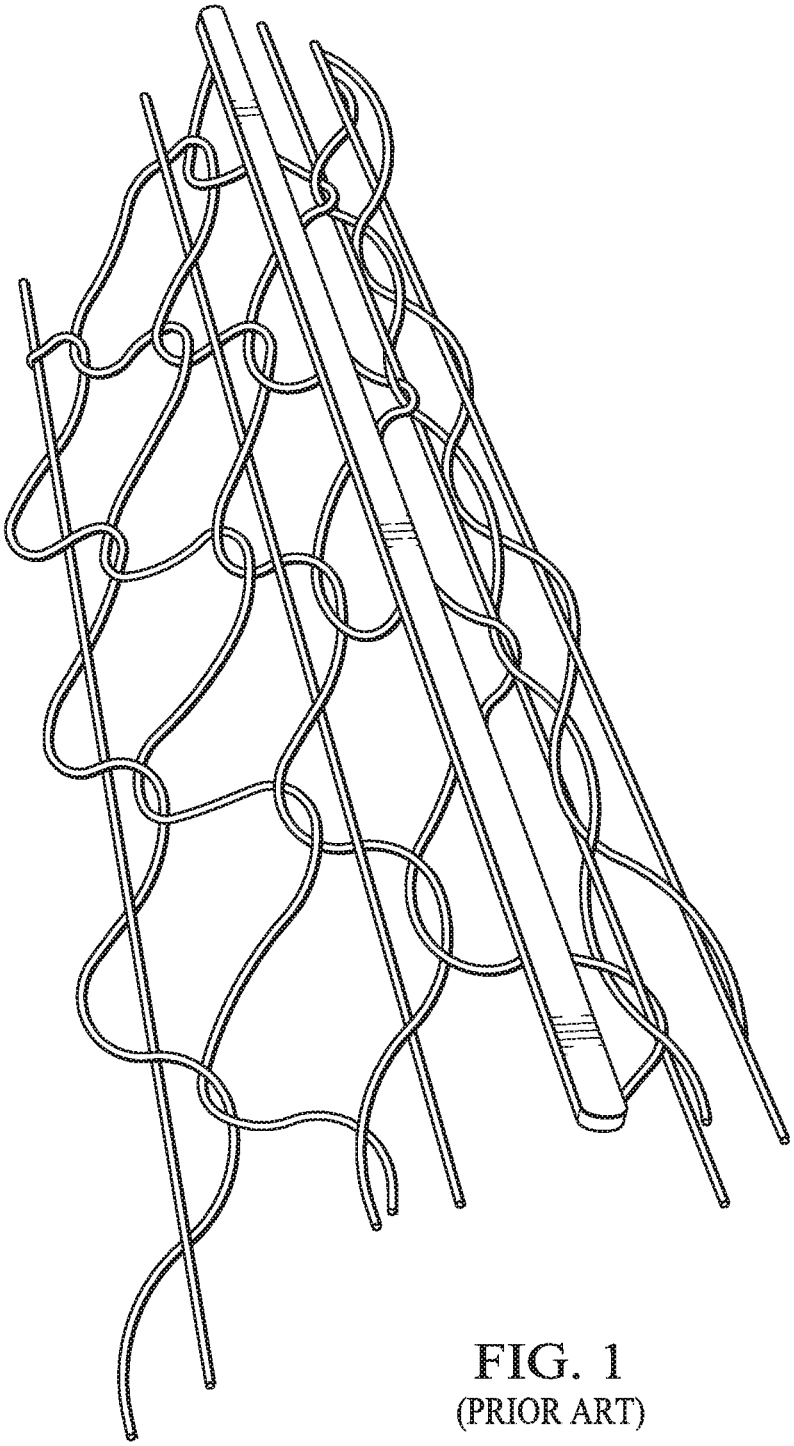
FIG. 1 (PRIOR ART)
FIG. 1 is a perspective view of a small section of a corner bead according to the prior art.
Figure 2:
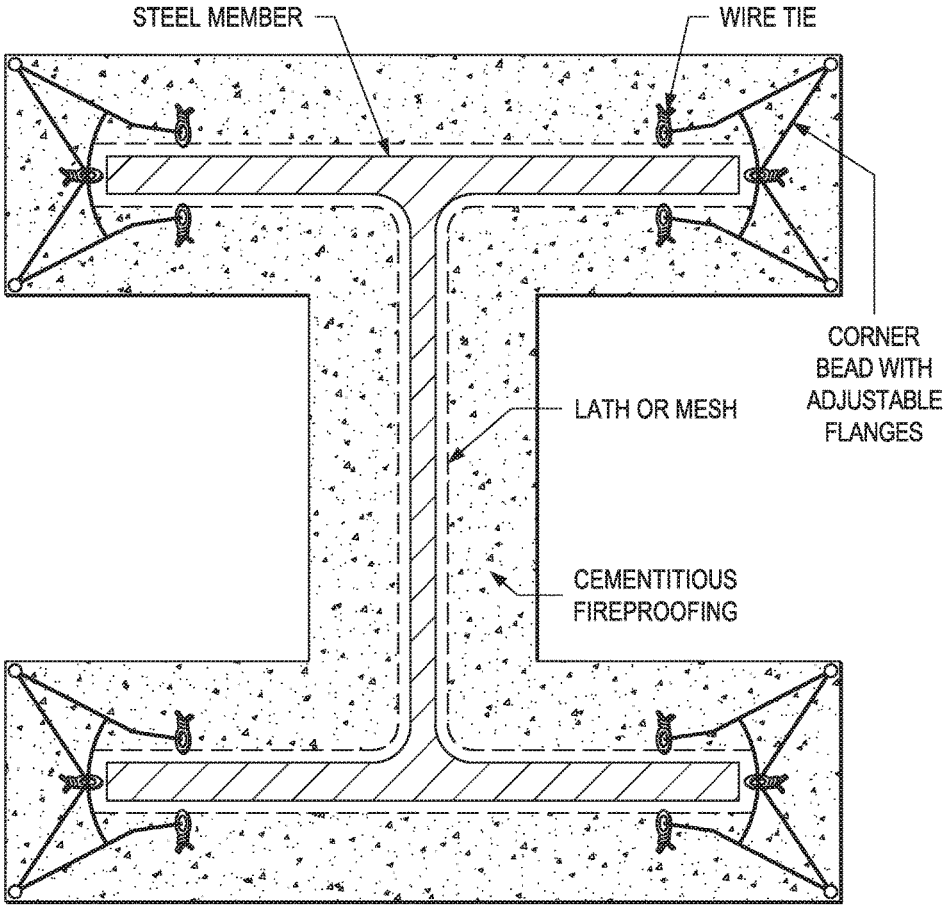
FIG. 2 (PRIOR ART)
FIG. 2 is a cross-sectional schematic view of a fireproofing structure utilizing a prior art corner bead installed according to a contour method.
Figure 3:
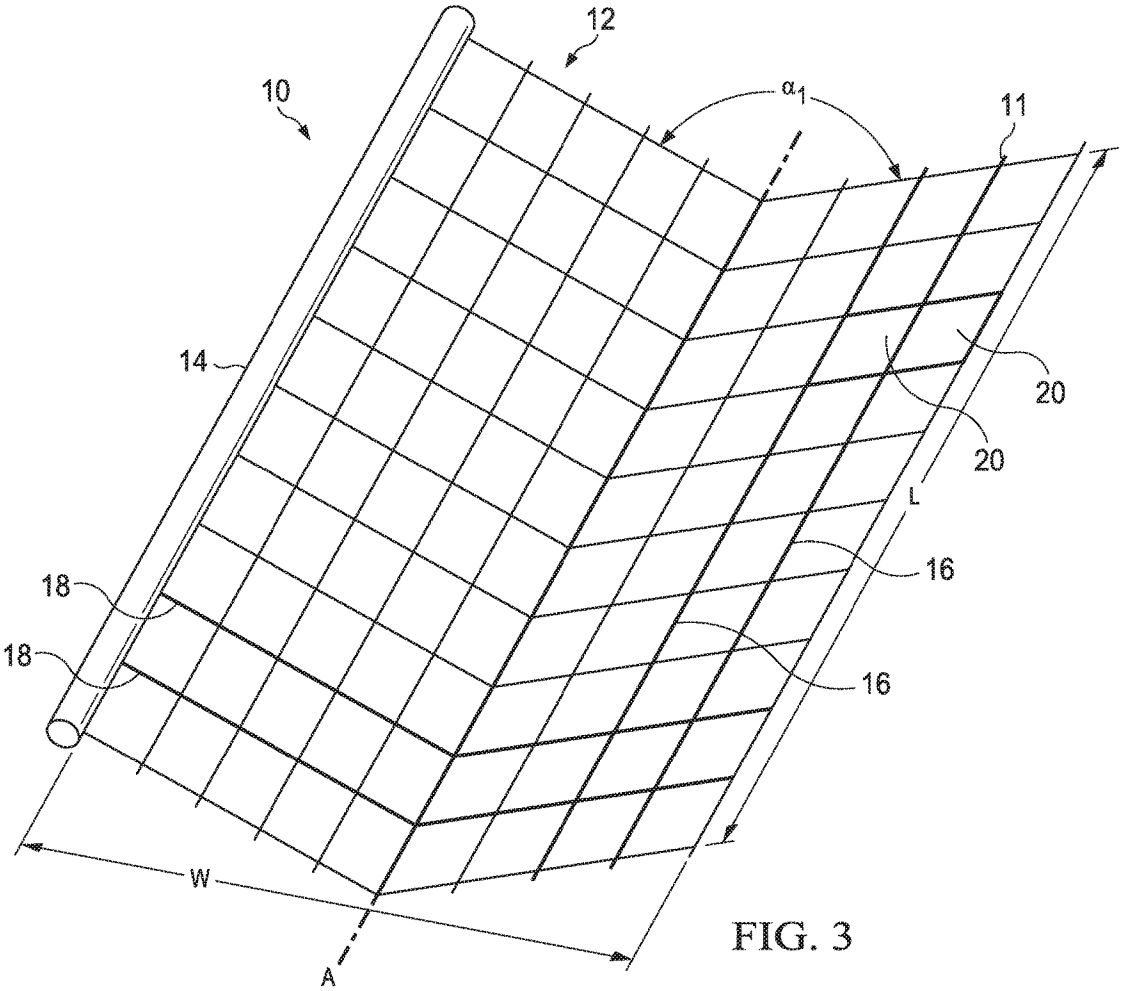
FIG. 3 is a perspective view of an exemplary small section of the corner bead of the present invention bent along a longitudinal axis and manufactured according to an embodiment of the present invention.

Referring to FIG. 3, corner bead 10 includes a plurality of longitudinal ribs 16 arranged substantially parallel with respect to a plurality of longitudinal axes, including longitudinal axis A and to each other, and a plurality of transverse ribs 18 distributed between and extending substantially perpendicular to the plurality of longitudinal axes and the plurality of longitudinal ribs 16. A set of void areas 20 is defined by the plurality of longitudinal ribs 16 and the plurality of transverse ribs 18, such that each void area 20 is bounded by at least two longitudinal ribs 16 and at least two transverse ribs 18. A section of corner bead 10 includes a single strip of welded wire fabric cut to a predetermined length L and a predetermined width W. The predetermined length L and the predetermined width W correspond to a predetermined fireproofing thickness.

In a preferred embodiment, corner bead 10 is made of a suitable metal, such as 16 gauge wire. Other suitable materials known in the art may be employed, including suitable plastics. In a preferred embodiment, corner bead 10 is a double welded wire fabric.

In a preferred embodiment, corner bead 10 has a set of bends integrally formed in corner bead 10 along the plurality of longitudinal axes. Any number of bends may be employed. Longitudinal axis A defines first wing 12 and single wire membrane 11. First wing 12 and single wire membrane 11 form angle $\alpha_1$ of approximately greater than 90 degrees, but less than approximately 180 degrees as further illustrated in FIGS. 4 and 5. A set of edges of first wing 12 defines a substrate to which nose 14 is attached. Nose 14, first wing 12, and second wing 12' (shown in FIG. 5) provide a rigid edge having a dam-like function, as will be further described below.

In a preferred embodiment, nose 14 is made of a suitable plastic, such as polyvinyl chloride. Other suitable materials known in the art may be employed.

Figure 4:
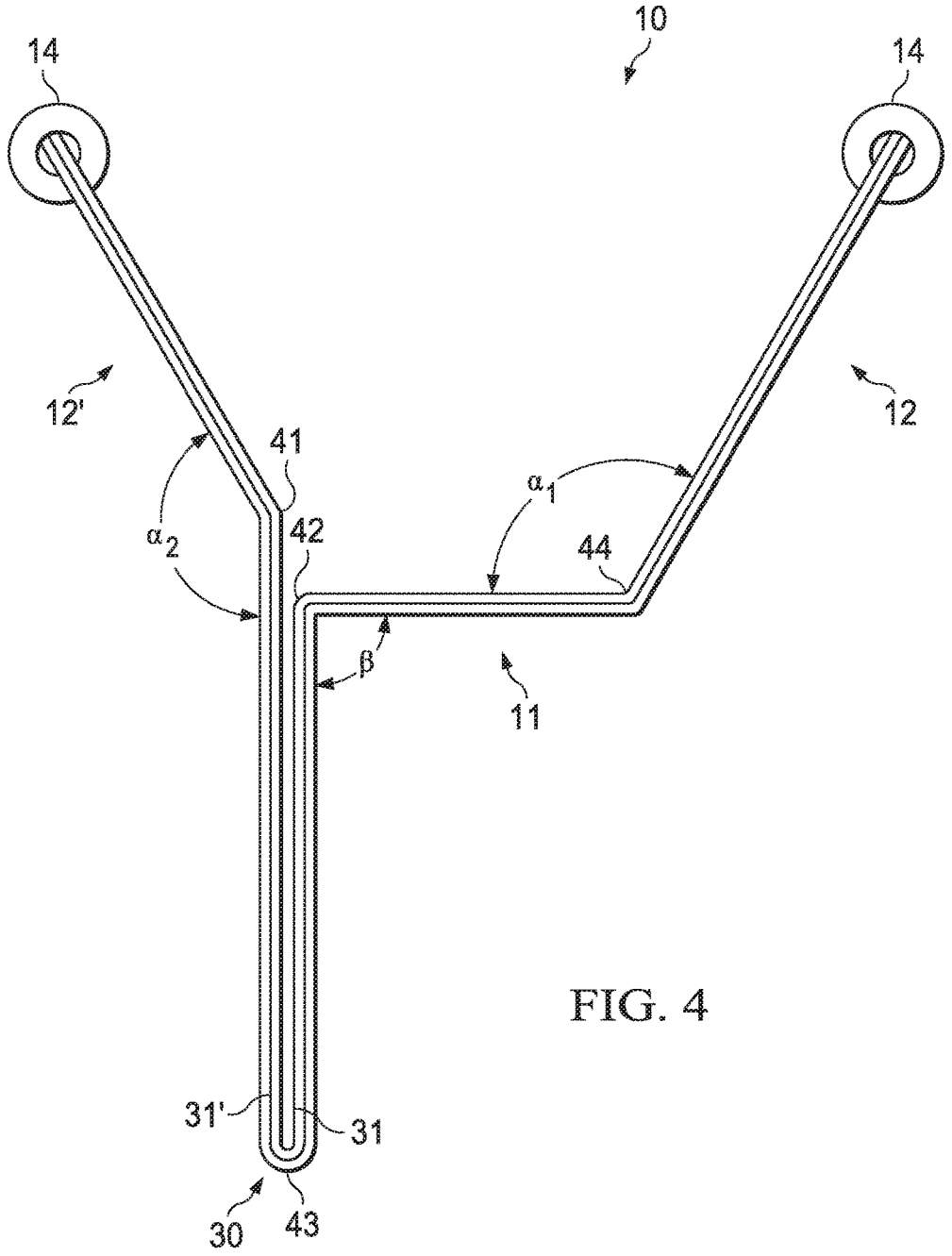
FIG. 4 is an enlarged cross-sectional schematic view of the self-aligning, double wire corner bead of the present invention.

Referring to FIG. 4, corner bead 10 is bent along a plurality of longitudinal lines 41, 42, 43, and 44, to provide a substantially continuous profile having a plurality of dihedral angles. Longitudinal line 44 defines first wing 12 and single wire membrane 11 extending laterally therefrom at angle $\alpha_1$. Angle $\alpha_1$ is approximately greater than 90 degrees, but less than approximately 180 degrees. Each of noses 14 is attached to first wing 12 and second wing 12'. Longitudinal line 42 defines single wire membrane 11 and leg 31 of double wire membrane 30 extending from single wire membrane 11 in a continuous manner. Single wire membrane 11 and leg 31 are separated by angle $\beta$. Angle $\beta$ is approximately 90 degrees. Longitudinal line 43 defines leg 31 of double wire membrane 30 and leg 31' of double wire membrane 30. Leg 31' is positioned substantially parallel to leg 31. Leg 31' substantially overlaps leg 31. Longitudinal line 41 defines second wing 12' and leg 31' of double wire membrane 30. Leg 31' extends away from second wing 12' at angle $\alpha_2$. Angle $\alpha_2$ is approximately greater than 90 degrees, but less than approximately 180 degrees.

Figure 5:
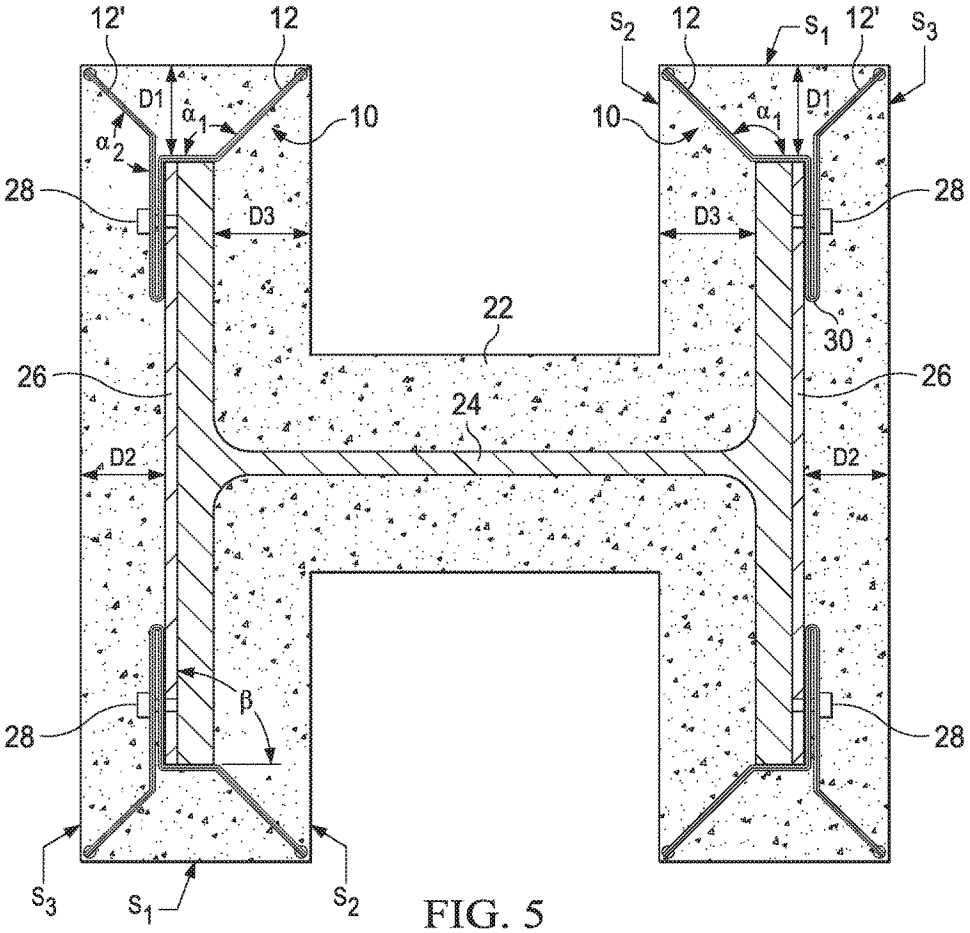
FIG. 5 is a cross-sectional schematic view of a fireproofing structure utilizing a self-aligning, double wire corner bead of the present invention according to the contour method.

In use, the improved, self-aligning, double wire corner bead 10 of the present disclosure is utilized in a contour-like manner, surrounding a structural steel member with fireproofing material. Referring to FIG. 5, double wire corner bead 10 is secured to structural steel member 24. First wing 12 is configured to establish a desired thickness of fireproofing material 22 along two surfaces of the structural steel member by providing a rigid screed edge to which nose 14 is attached. Double wire membrane 30 is secured to structural steel member 24, as will be further described below. Fireproofing material 22 surrounds the dimensions of the structural steel member 24 in a contour-like manner, tracing structural steel member 24 in all dimensions. The single strip of corner bead 10 allows uniform distribution of fireproofing material 22 along three surfaces, surfaces $S_1$, $S_2$, and $S_3$.

Referring to FIGS. 4 and 5, the width of the wings 12 and 12' determines distances $D_1$, $D_2$, and $D_3$, and defines generally planar surfaces $S_1$, $S_2$, and $S_3$ forming a set of corners of fireproofing material 22 distributed around structural steel member 24. Similarly, any of distances $D_1$, $D_2$, and $D_3$ are optionally altered by changing angles $a_1$ and $a_2$. Angles $a_1$ and $a_2$ are substantially equal and measure approximately greater than 90 degrees, but less than 180 degrees. Angle $\beta$ measures approximately 90 degrees. For example, the smaller (less obtuse) angle $\alpha_1$ is between first wing 12 and the single wire membrane 11 the longer distance $D_1$ is between lath 26 and surface $S_1$, and the shorter distance $D_3$ is between lath 26 and surface $S_2$. Similarly, the less obtuse angle $\alpha_2$ is between second wing 12' and leg 31' of double wire membrane 30, the longer distance $D_2$ is and the shorter distance $D_1$ is making distributed fireproofing material 22 thicker along surface $S_3$ in relation to a thinner strip of fireproofing material 22 along surface $S_1$.

In a preferred embodiment, the determination of angles $\alpha_1$ and $\alpha_2$ should be such that a uniform thickness of fireproofing material 22 along surface $S_1$ is achieved.

In one embodiment, lath 26 is distributed around structural steel member 24. Single wire membrane 11 is attached through lath 26 into structural steel member 24 by pneumatic fastener 28 at a single fastening position on single wire membrane 11. Other joining or attaching means known in the art, such as welded pins or screws, may be employed.

In another embodiment, each of single wire membrane 11 and double wire membrane 30 is attached to structural steel member 24 by pneumatic fastener 28 at a single fastening position on double wire membrane 30.

In another embodiment, leg 31 and leg 31' of double wire membrane 30 are attached through lath 26 into structural steel member 24 by pneumatic fastener 28 at a single fastening position on double wire membrane 30. Other joining or attaching means known in the art, such as welded pins or screws, may be employed. According to one embodiment of the present invention, lath 26 is optionally distributed along the entire perimeter of structural steel member 24 to be fireproofed (not shown). In another embodiment, lath 26 is distributed along a portion of the perimeter of structural steel member 24.

In other embodiments, any number of fastening positions and locations may be employed.

The width of first wing 12 and second wing 12' along with nose 14 attached to the outer edges of both wings serves as a dam during the process of fireproofing. Fireproofing material 22 is then sprayed onto lath 26 and screened off using the location of nose 14 to determine the finished thickness of fireproofing material 22.

Referring to FIG. 5, in a shop application, i.e., fireproofing material 22 is applied to structural steel member 24 in a pre-fabrication facility, the cementitious composition is sprayed or poured one layer at a time on a surface of lath 26 positioned horizontally. Structural steel member 24 is then rotated 90 degrees and the adjacent surfaces are positioned horizontally to allow easy application of fireproofing material 22. With this process in place, each successive spraying is performed which allows hardening of fireproofing material 22 before the next rotation of structural steel member 24. As can be seen, the dam-like functionality of corner bead 10 according to one embodiment of the present invention is critical as it provides an appropriate keying surface to bond the subsequent layers of fireproofing material 22. Each structural steel member 24 is turned to uniformly apply the cementitious material to all surfaces.

It will be appreciated by those skilled in the art that any type of member may be employed.

In a field application on a job site, structural steel members 24 are erected into a structure prior to fireproofing, and all surfaces of structural steel member 24 may be sprayed or troweled onto the surface of lath 26 at the same time (not shown).

Figure 6:
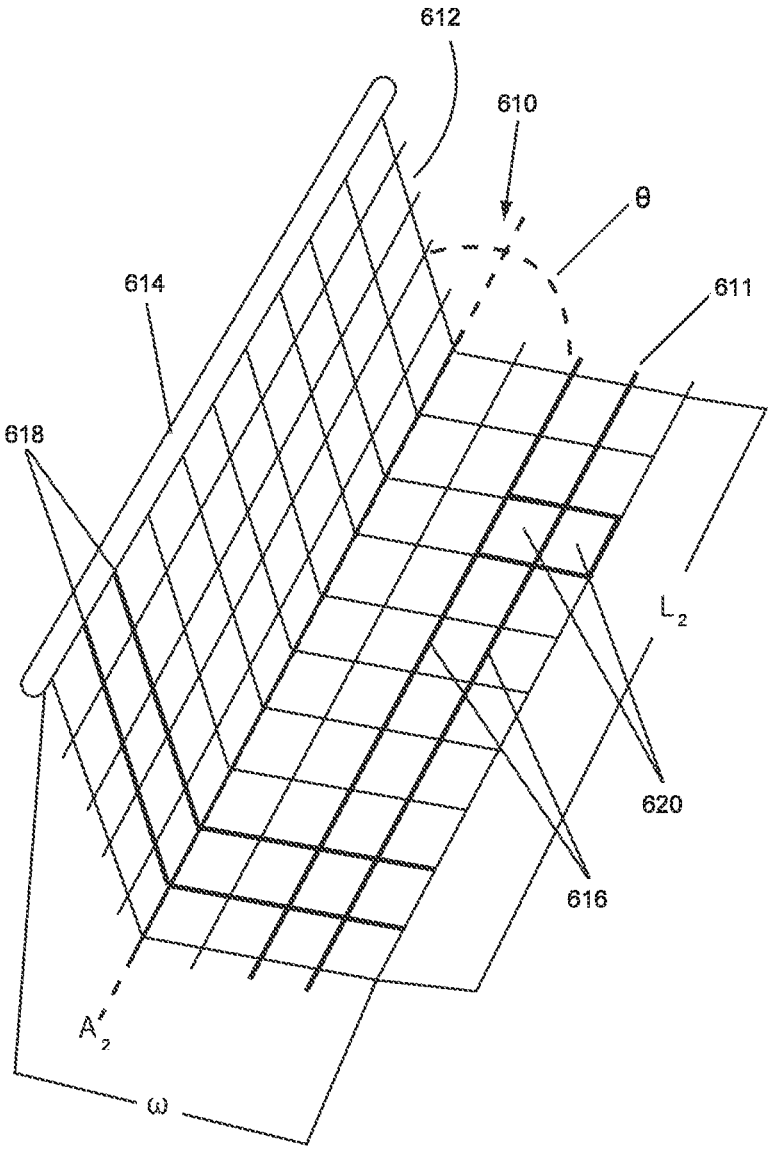
FIG. 6 is a perspective view of a small section of the corner bead manufactured according to one of the embodiments of the present invention.

Referring to FIG. 6 in another embodiment, a corner bead structure comprising a strip of welded wire fabric 610 cut to the appropriate length $L_2$ and width $\omega$ for the fireproofing thickness and bent longitudinally to form a structure having a longitudinal axis $A_2$, said longitudinal axis to define a first wing 611 and a second wing 612, said first wing 611 and said second wing 612 forming an angle θ of approximately more than 90 degrees but less than approximately 180 degrees. The second wing's outer edge comprises a substrate forming a nose 614, said nose 614 together with the second wing 612 providing a rigid edge of dam-like functionality.

As further shown in FIG. 6, the corner bead structure (typically 16 gauge welded wires) comprises a plurality of longitudinal metal ribs 616 arranged in substantially parallel fashion to the longitudinal axis $A_2$ and to each other and the plurality of transverse metal ribs 618 disposed between and extending substantially perpendicular to the longitudinal axis $A_2$ and the longitudinal metal ribs 616. A plurality of void areas 620 of the approximate size 0.5"×0.5" are disposed between the longitudinal ribs 616 and the transverse ribs 618, such that each said void area 620 is bounded by at least two longitudinal ribs 616 and at least two transverse ribs 618.

Figure 7:
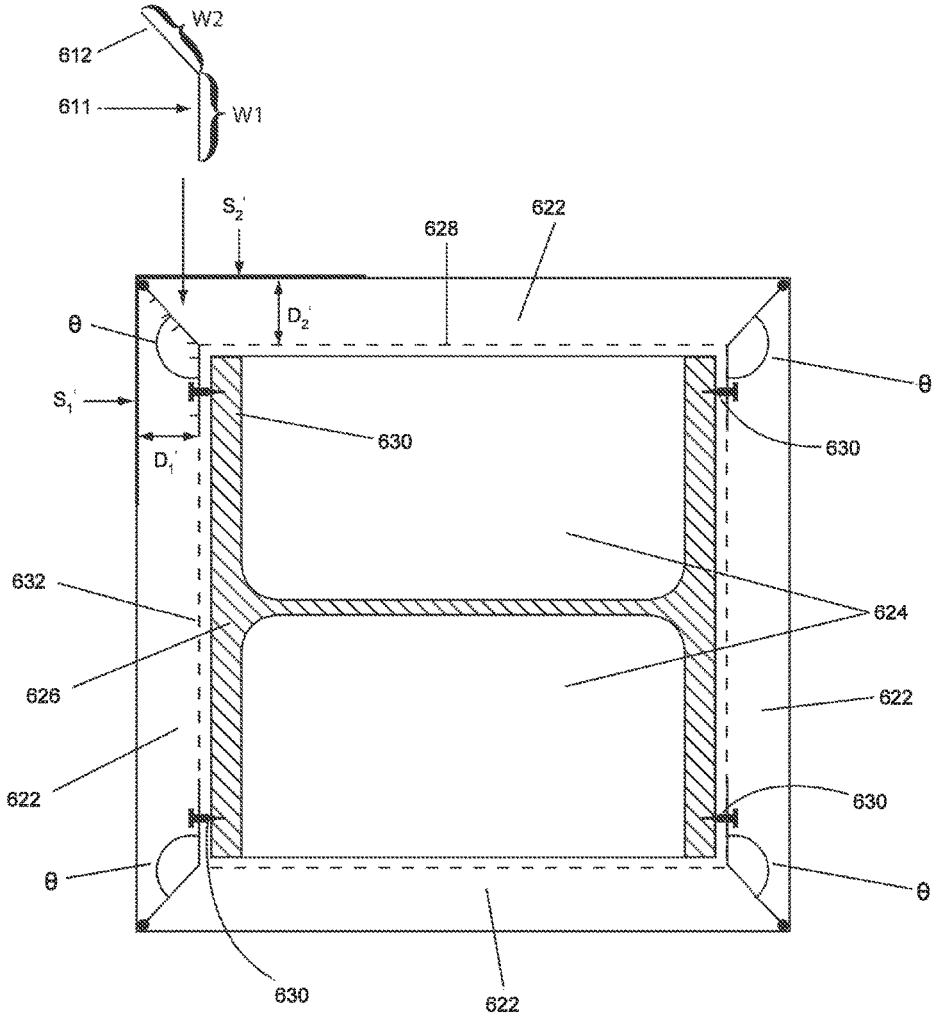
FIG. 7 is a cross-sectional schematic view of the fireproofing structure utilizing a corner bead of the present invention according to the hollow-box method.

In general, two methods of enveloping the structural steel member with the fireproofing material may be utilized. As shown in FIG. 7, the cementitious fireproofing material 622 surrounds the dimensions of the structural steel in a hollow-box manner, leaving empty void areas 624 between the structural steel member 626.

Figure 8:
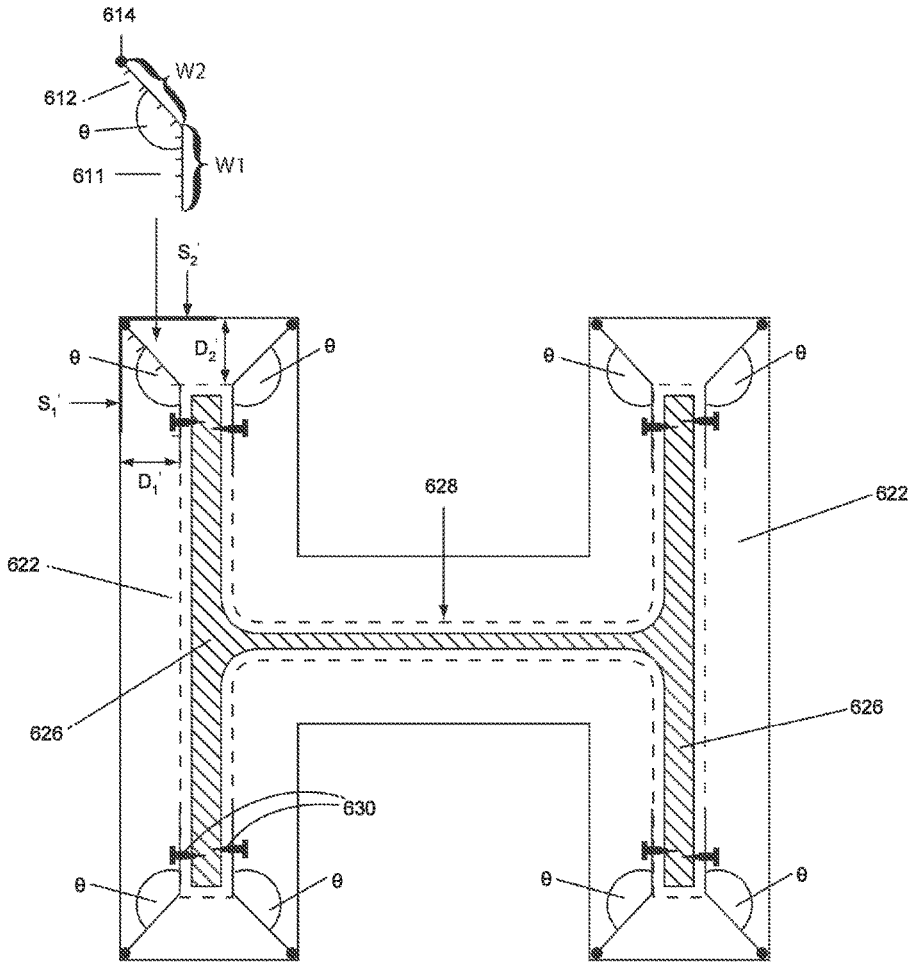
FIG. 8 is a cross-sectional schematic view of the fireproofing structure utilizing a corner bead of the present invention according to the contour method.

As shown in FIG. 8, the cementitious fireproofing material 622 surrounds the dimensions of the structural steel member 626 in a contour-like manner, tracing the structural steel member 626 in all its dimensions.

As can be seen most clearly in FIGS. 7 and 8, the second width W2 of a second wing 612 determines the distances ($D_1'$ and $D_2'$) between the lath 628 disposed over the structural steel member 626 and the two planar surfaces, $S_1'$ and $S_2'$ forming a corner of the fireproofing material 622 disposed around the structural steel member 626. Similarly, the distances, $D_1'$ and $D_2'$, may be altered by changing an angle θ at which the strip of the welded material with pre-determined width ω is bent along its longitudinal axis $A_2$. For example, the smaller (less obtuse) the angle θ between the first wing 611 and the second wing 612, the longer is the distance $D_1'$ between the lath 628 and the surface $S_1'$, and the shorter is the distance $D_2'$ between the lath 628 and the surface $S_2'$. Consequently, such change in the angle causes the strip of the fireproofing material 622 to be thicker along surface $S_1'$ in relation to the thickness of the fireproofing strip 622 along surface $S_2'$.

In a further development of the subject matter described with reference to FIGS. 6, 7, and 8, the first wing 611 is attached through the lath 628 into the structural steel member by the pneumatic fastener 630. Other contemplated joining (attaching) means are welded pins or screws. The second wing 612 along with the plastic nose 614 attached to the outer edge of the second wing 612 serves as a dam during the process of fireproofing. The fireproofing material is then sprayed onto the lath 628 and screeded off using the plastic nose's 614 location to determine the finished thickness of the fireproofing material.

In a shop application (i.e., fireproofing is applied in a facility of the applicant to individual steel members), the cementitious composition is sprayed or poured one at a time on one horizontal surface 632 of lath 628 as shown in FIG. 7. The steel member 626 is then rotated 90 degrees and the adjacent surfaces become horizontal to allow easy application of the fireproofing material. With this process in place, each successive spraying is performed which allows hardening of the fireproofing material before the next rotation of the steel member. This is why the dam-like functionality of the corner bead according to one embodiment of the present invention is critical as it provides an appropriate keying surface to bond the subsequent layers of the fireproofing material. Each steel member is turned four times to uniformly apply the cementitious material to all surfaces.

In a field application (outside of applicant's facility), where the members are erected into a structure prior to fireproofing, all surfaces of the steel member may be sprayed or troweled onto the lath surfaces at the same time (not shown). The process is similar regardless of whether the contour or hollow-box application is utilized.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or greater than one instance, requires at least the stated number of instances of the element, but is not intended to exclude from the scope of the claim a structure or method having more instances of that element than stated. The word "comprise" or a derivative thereof, when used in a claim, is used in a nonexclusive sense that is not intended to exclude the presence of other elements or steps in acclaimed structure or method.

The invention claimed is:

1. A corner bead for fireproofing a member, comprising:
- a welded wire fabric;
- a longitudinal bend integrally formed in the welded wire fabric;
- a first wing defined by the longitudinal bend;
- a second wing defined by the longitudinal bend, extending away from the first wing;
- an adjustable angle between the first wing and the second wing;
- a fire proofing thickness defined by the adjustable angle along a set of adjacent corner sides of the member; and,
- wherein the welded wire fabric is only fastened to the member at a fastening position on the first wing.

2. The corner bead of claim 1, further comprising a substrate integrally formed in the second wing, opposite the longitudinal bend.

3. The corner bead of claim 2, further comprising a nose formed by the substrate.

4. The corner bead of claim 1, wherein the adjustable angle is in a range from greater than approximately 90 degrees to less than approximately 180 degrees.

5. The corner bead of claim 1, wherein the welded wire fabric comprises:
- a plurality of longitudinal ribs;
- a plurality of transverse ribs arranged substantially perpendicular to the plurality of longitudinal ribs; and,
- a plurality of voids defined by the plurality of longitudinal ribs and the plurality of transverse ribs.

6. The corner bead of claim 1, wherein the first wing is a first flexible strip.

7. The corner bead of claim 1, wherein the second wing is a second flexible strip.

* * * * *